United States Patent [19]

Manning, Jr. et al.

[11] Patent Number: 4,512,260

[45] Date of Patent: Apr. 23, 1985

[54] TRAIN HOLDING APPARATUS WITH MEANS FOR RELIEVING THE LOAD IMPOSED THEREON DURING DISENGAGEMENT

[75] Inventors: Edward T. Manning, Jr.; Grant S. Horan, both of Bay Village, Ohio

[73] Assignee: Dravo Corporation, Pittsburgh, Pa.

[21] Appl. No.: 427,003

[22] Filed: Sep. 29, 1982

[51] Int. Cl.[3] ..... B61B 12/00; B61J 3/00; B61K 7/16

[52] U.S. Cl. ..... 104/252; 104/154; 104/162; 104/176

[58] Field of Search ..... 104/154, 162, 176, 252

[56] References Cited

U.S. PATENT DOCUMENTS

| | | | |
|---|---|---|---|
| 3,146,728 | 9/1964 | Doorley | 104/162 |
| 4,006,691 | 2/1977 | Kacir et al. | 104/176 |
| 4,099,707 | 7/1978 | Anderson | 104/162 X |
| 4,252,064 | 2/1981 | Ratcliff, Jr. et al. | 104/162 |

*Primary Examiner*—Robert B. Reeves
*Assistant Examiner*—Howard Beltran
*Attorney, Agent, or Firm*—Parmelee, Miller, Welsh & Kratz

[57] ABSTRACT

The piston rod of at least one hydraulic cylinder is axially connected to a pivot pin about which the car holding arm of a car holding device rotates in a vertical plane to engage the couplings between railroad cars. In the case of a single hydraulic cylinder, the inner chamber of the cylinder, located closest to the car holding arm, is connected to the outer chamber on the other side of the piston by a conduit. When hydraulic cylinders are connected to each pivot pin of the car holding arm, the inner chambers of the two cylinders are interconnected by a conduit as are the two outer chambers. When flow through the conduits is blocked by a solenoid valve, movement of the car holding arm in the direction parallel to the track is resisted and the arm holds the train in position. When the solenoid valve is open, the load imposed by the train on the car holding arm causes the hydraulic fluid to flow between the interconnected chambers and the arm moves parallel to the track until the load is relieved so that the arm can be raised out of engagement with the train under no-load conditions. A pump can be selectively connected to the conduit to transfer hydraulic fluid between chambers to recenter the raised arm or to position it precisely prior to reengagement with the train.

8 Claims, 7 Drawing Figures

TRAIN HOLDING APPARATUS WITH MEANS FOR RELIEVING THE LOAD IMPOSED THEREON DURING DISENGAGEMENT

BACKGROUND OF THE INVENTION

1. Field of the Invention

This invention relates to train handling apparatus and more particularly to apparatus for holding the cars in place on the track and for relieving the load imposed by the cars on the apparatus during disengagement.

2. Prior Art

Bulk material carrying trains are typically loaded and unloaded by cycling the cars, either singly or up to several at a time, through work stations designed for efficient, high-speed load transfer operations. It is common practice to utilize specialized car handling equipment to index the cars through the work stations, both to expedite load transfer and to avoid tying up a locomotive. U.S. Pat. No. 4,006,691, for example, discloses car handling apparatus which indexes cars through a rotary car dumper using a car positioner which moves along its own set of tracks parallel to the railroad track and has an arm which reaches between the cars to engage the car couplings. The apparatus disclosed in this patent also includes a train holding device which engages the couplings between cars to hold them against forces resulting from track gradient, etc. while the car positioner disengages and repositions for another indexing stroke. This car holding device includes a base mounted alongside the track and an arm mounted on the base for pivotal movement in a vertical plane between the car holding and a retracted position. The arm can move a limited distance along its pivot axis parallel to the track to transfer impact loading between the cars to shock absorbers. Although not shown in the patent, installed units have a camming mechanism which recenters the arm as it is retracted. However, this prior art arm is not provided with its own mechanism for initiating movement parallel to the track while in engagement with the train. Consequently, the train positioner must be used to accurately locate the railroad car couplers adjacent the holding arm so that it can engage and disengage under no-load conditions. Since the positioner may be several car lengths away from the holding arm and since the positioner must move very slowly during these operations, several seconds may be required for such positioning. The cumulative effect of such delays in detrimental to the overall capacity of the dumper station.

SUMMARY OF THE INVENTION

In accordance with the present invention, apparatus for holding railroad cars in a train in place on a railroad track and for relieving the load carried thereby during disengagement from the train includes a base positioned adjacent the railroad track. A car holding arm having apparatus on one end for engaging the couplings on the railroad cars is mounted on the base for movement between a car engaging position, in which the arm engages a coupling on a car to hold the car in position on the track, and a retracted position, in which the cars are movable along the track without interference from the car holding arm. The arm is mounted so that it is also capable of movement in a direction parallel to the track. Thrust absorbing apparatus is connected to the car holding arm for selectively resisting movement of the arm in this direction. Control apparatus selectively condition the thrust absorbing apparatus to resist movement of the car holding arm in response to loads imposed thereon by the cars when the arm is in engagement with the coupling on a railroad car to hold the cars in place on the track, and to permit movement of the car holding arm in the direction parallel to the track to relieve the load imposed by the cars on the arm when the arm is to be disengaged from the train. In this manner, the car positioner, or other apparatus used to maneuver the train of cars, need not be positioned as precisely as with prior art train holding devices when picking up the load held by the holding device, thereby resulting in a saving in time. Even a small savings in time for each indexing of the positioner can be significant when it is multiplied by the number of cycles required for loading or unloading a sizable train.

The thrust absorbing apparatus preferably takes the form of at least one hydraulic cylinder positioned adjacent the holding arm. A piston slidable in a direction parallel to the track in a working chamber in the cylinder housing divides the working chamber into two chambers, and a piston rod connects it to the car holding arm for movement therewith. The control apparatus includes a conduit connecting the two chambers and a valve in the conduit which, when closed, prevents the flow of hydraulic fluid between the chambers to restrain the holding arm and prevent its movement in the direction parallel to the tracks and, when it is open, allows the the hydraulic fluid to flow between the chambers so that the piston and the car holding arm connected to the piston through the piston rod can move parallel to the direction of the track. When two hydraulic cylinders are used, one is placed on each side of the car holding arm so that the respective pistons divide the working chamber of each cylinder into an inner chamber adjacent the car holding arm and an outer chamber. A first conduit interconnects the inner chambers of each cylinder while a second conduit connects the outer chambers. Valves then prevent or allow the flow of hydraulic fluid between the two inner and two outer chambers to resist or permit movement of the car holding arm.

Additional features include an accumulator for assuring that the hydraulic circuits are kept full of fluid and shock absorbing apparatus, preferably between the piston rods and the car holding arm, for absorbing impact loads on the arm.

The preferred embodiment of the invention also includes apparatus for recentering the arm in the direction parallel to the railroad track in preparation for the next indexing cycle. The recentering apparatus may take the form of cams which guide the car holding arm to the centered position as it is withdrawn from the car engaging position or a hydraulic pump can be connected to the conduit to recenter the car holding arm through the hydraulic cylinder or cylinders. Even in the configuration where two hydraulic cylinders are used, the pump need only be connected to one conduit as the hydraulic fluid need only be permitted to circulate freely through the other conduit. The hydraulic recentering scheme can also be used to position the arm accurately prior to engagement with the train, thereby reducing the accuracy required of the train positioner.

Also in the preferred embodiment of the invention, the arm is mounted on the base for pivotal movement in a vertical plane between the train engaging and a retracted position by axially aligned pivot pins extending in opposite directions parallel to the railroad track from the second end of the car holding arm. The pivot pins are axially slidable in the mounting to give the car holding arm the capability to move in the direction parallel to the track. The piston rod of each hydraulic ram is then conneccted to the adjacent pivot pin.

DESCRIPTION OF THE PREFERRED EMBODIMENTS

Figure 1:
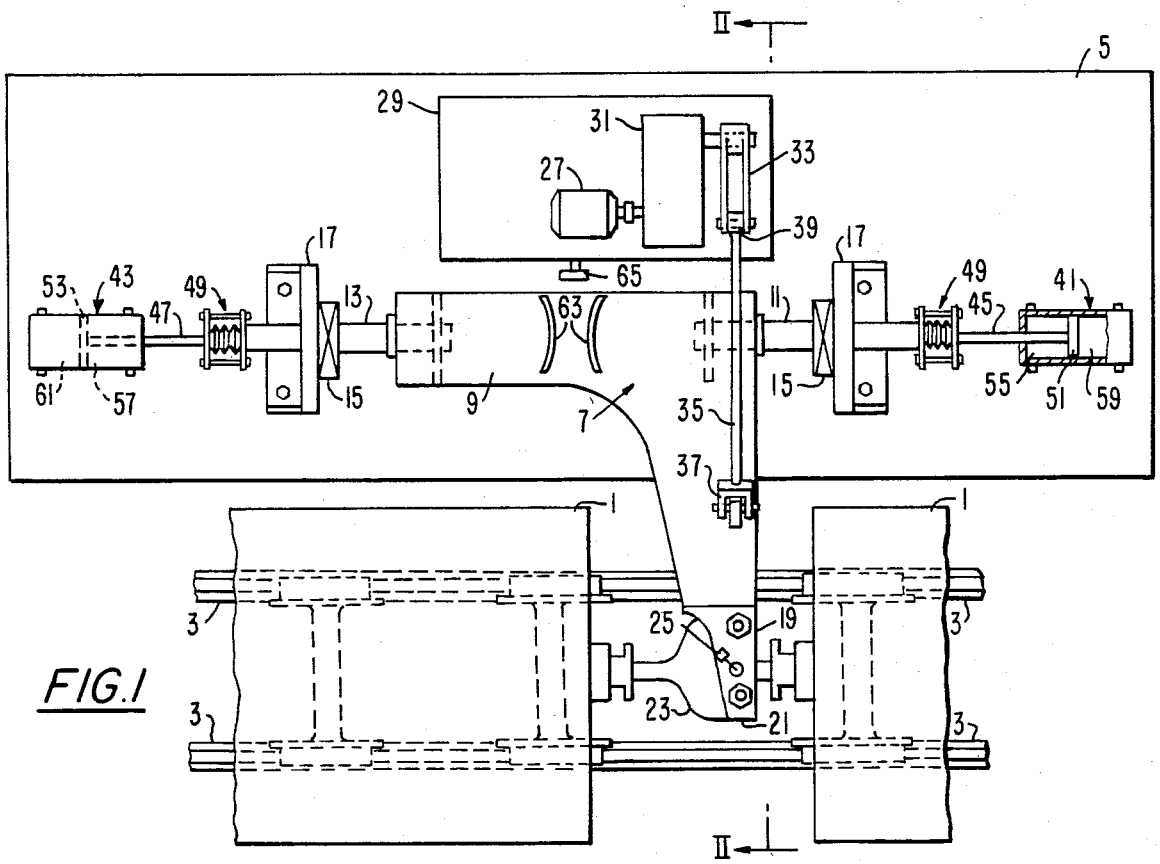
FIG. 1 is a plan view of a car holding apparatus in accordance with the teachings of the present invention.
Figure 2:
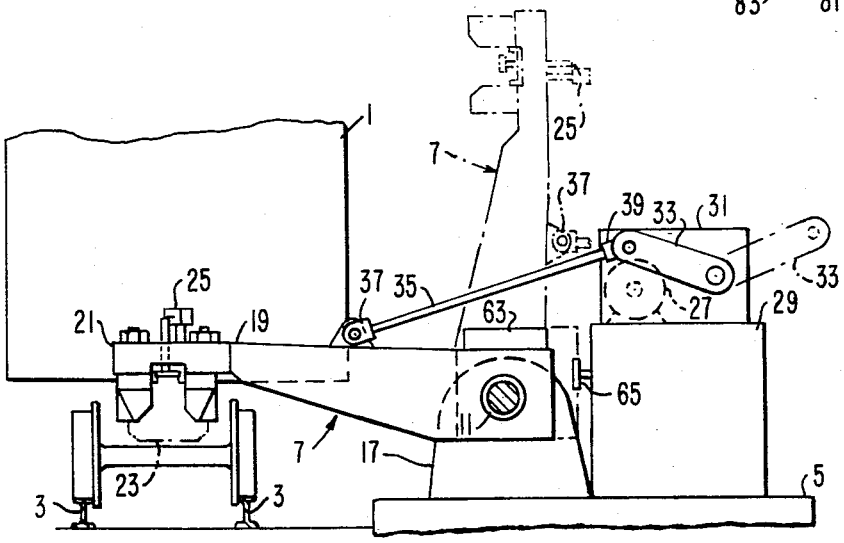
FIG. 2 is a vertical section through the car holding apparatus of FIG. 1 taken along the line II—II.

FIGS. 1 and 2 illustrate a device according to the invention for holding the cars 1 of a train in place against gradient, etc. on a railroad track 3. The device includes an elongated base 5 mounted adjacent the track. An L-shaped car holding arm 7 is mounted for pivotal movement in a vertical plane about the longitudinal axis of one leg 9 of the L-shaped arm 7 by axially aligned pivot pins 11 and 13 extending in opposite directions from the ends of leg 9 parallel to the track 3. The pins 11 and 13 are journaled for rotational and axial movement in bearing 15 supported by stanchions 17 mounted on the base 5.

The free or first end of the other leg 19 of the car holding arm 7 is provided with a coupling head 21 which slides over and engages the couplings 23 on coupled or uncoupled cars 1 as the arm 7 rotates toward the horizontal position shown in full line in FIGS. 1 and 2. This coupling head 21, which may be of the type shown in U.S. Pat. No. 4,006,691, incorporates a sensing device 25 which indicates when the coupler head has fully engaged the car coupling.

The car holding arm 7 is rotated in a vertical plane from the horizintal car engaging position shown in FIGS. 1 and 2 in solid line to a vertical, retracted position shown in phantom line in FIG. 2 in which the cars 1 are free to move along the track 3 without interference, by a motor 27 mounted on a platform 29 supported by the base 5. The motor 27 drives a gear reducer 31 which turns a crank 33 connected to the leg 19 of car holding arm 7 through a linkage 35. The linkage 35 is connected to the car holding arm 7 and the crank 33 by universal joints 37 and 39 to accommodate for movement of the car holding arm 7 in the direction parallel to the track 3. In an alternative arrangement, the car holding arm can be raised and lowered by a hydraulic cylinder in place of the motor driven assembly shown.

In order to control movement of the car holding arm 7 in the direction parallel to the track 3, a pair of double-acting hydraulic cylinders 41 and 43 are mounted on the base 5 on each side of the car holding arm 7 with the piston rods 45 and 47 axially aligned with, and connected to, the pivot pins 11 and 13 by shock absorbing devices 49. The pistons 51 and 53 of the hydraulic cylinders 41 and 43 divide the working chamber of each cylinder into an inner chamber 55 and 57 and an outer chamber 59 and 61, respectively. Through control of the flow of hydraulic fluid beteen the two inner chambers 55 and 57 and between the two outer chambers 59 and 61, in a manner to be discussed in more detail below, movement of the car holding arm in the direction parallel to the track 3 can be controlled.

A car holding arm 7 that has been displaced in the direction parallel to the track while in engagement with the train can be centered as it is raised by a pair of centering cams 63, mounted on the leg 9 of the car holding arm, which are engaged by a roller 65 mounted on the support 29. This mechanical device for centering the car holding arm can be replaced by, or used in conjuction with, the hydraulic system for moving the car holding arm in the direction parallel to the track as discussed below.

Figure 3:
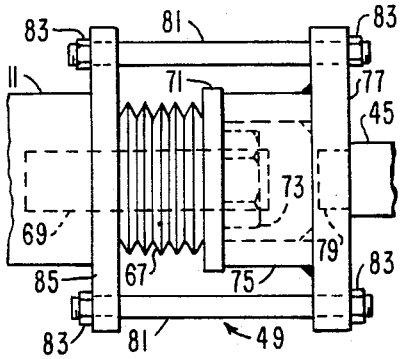
FIG. 3 is an enlarged view of a portion of the apparatus of FIGS. 1 and 2.

The details of a suitable shock absorbing device 49 mounted between the pivot pins of the car holding arm and the piston rods is illustrated in FIG. 3 for the right side of the apparatus shown in FIG. 1. A number of annular pads 67 of resilient material, such as synthetic rubber, are slidably retained on a stub shaft 69, extending axially from the pivot pin, by a washer 71, also slidable on the stub shaft, and by a nut 73 screwed onto the threaded end of the shaft 69. The washer 71 butts against an annular stop 75 welded to an end plate 77 secured to a boss 79 on the end of the piston rod 45. Elongated bolts 81 with nuts 83 on each end thereof tie the end plate 77 to another plate 85 slidably mounted on the stub shaft 69 between the pads 67 and the end of shaft 11. The bolts 81, which are slidable with respect to at least one of the plates 77 and 85, provide the tension connection between pivot pin 11 and piston rod 45. Shock loading is absorbed by the pads 67 as the stub shaft 69 is driven toward the plate 77 within the annular stop 75 during compression and as the plate 85 is pulled away from the pivot pin 11 during tension.

Figure 4:
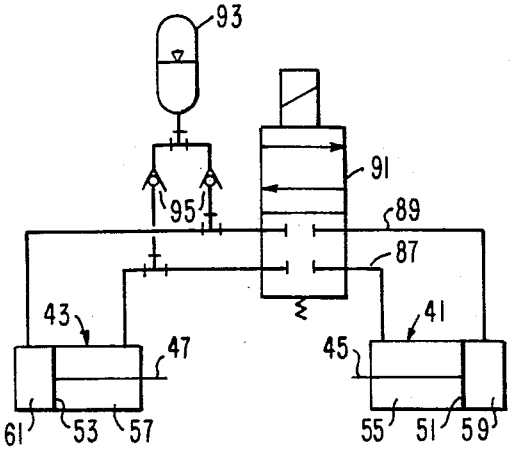
FIG. 4 is a schematic diagram of the hydraulic system used with the car holding apparatus of FIGS. 1 and 2.

FIG. 4 illustrates schematically the hydraulic circuit for the car holding device of FIGS. 1 and 2. The inner chambers 55 and 57 of hydraulic cylinders 41 and 43, respectively, are interconnected by a first conduit 87 while the outer chamber 59 and 61 are interconnected by a second conduit 89. A solenoid operated valve 91 is spring loaded to the position shown in which hydraulic fluid is prevented from flowing through the conduits 87 and 89. This hydraulically locks the car holding arm 7 from moving in the direction parallel to the track 3. When the solenoid valve 91 is energized, it switches to a second position in which hydraulic fluid can flow beween the inner chambers and between the outer chambers under the influence of any load imposed on the pistons 51 and 53 through the piston rods 45 and 47 connected to the car holding arm. An accumulator 93 is connected to each conduit through a check valve 95 to make up for leakage and therefore ensure that each hydraulic circuit remains filled with fluid so that the load is shared evenly between the two hydraulic cylinders and so that there is no slack in the system.

Figure 5:
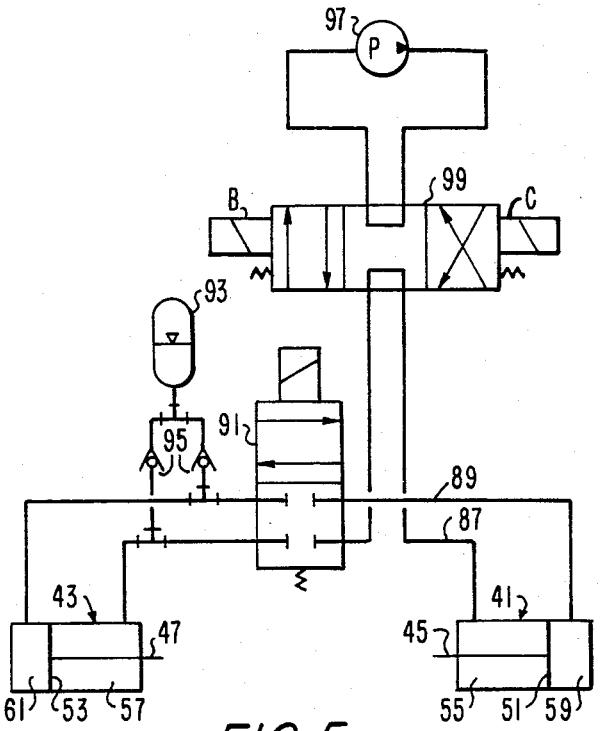
FIG. 5 is a schematic diagram of a modified hydraulic system used with the apparatus of FIGS. 1 and 2 including apparatus for hydraulically recentering the car holding arm.

FIG. 5 illustrates a modification to the hydraulic system of FIG. 4 to provide for controlled movement of the car holding arm. A pump 97 is selectively switched into one conduit by a double solenoid valve 99 to pump hydraulic fluid between the interconnected chambers and thereby reposition the car holding arm. In the configuration shown, the pump is selectively switched into the conduit 87 which connects the inner chambers of hydraulic cylinders 41 and 43. Double solenoid valve 99 is spring loaded to the position shown in FIG. 5, so that with both solenoids B and C deenergized, the pump 99 is not connected to conduit 87 and the system responds as discussed in connection with FIG. 4. With valve 91 energized to interconnect the inner and outer chambers of the hydraulic cylinders, either solenoid B or C of valve 99 may be energized to pump hydraulic fluid from one inner chamber to the other. Fluid in the outer chambers will be forced through conduit 89 and the open valve 91 as the pistons 51 and 53 are displaced.

Figure 6:
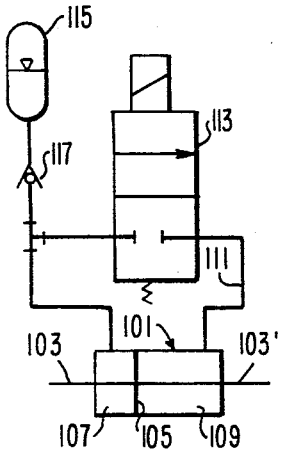
FIG. 6 is a schematic diagram of a hydraulic system for a modified form of the car holding apparatus of FIGS. 1 and 2 in which a hydraulic ram is provided on only one side of the car holding arm.
Figure 7:
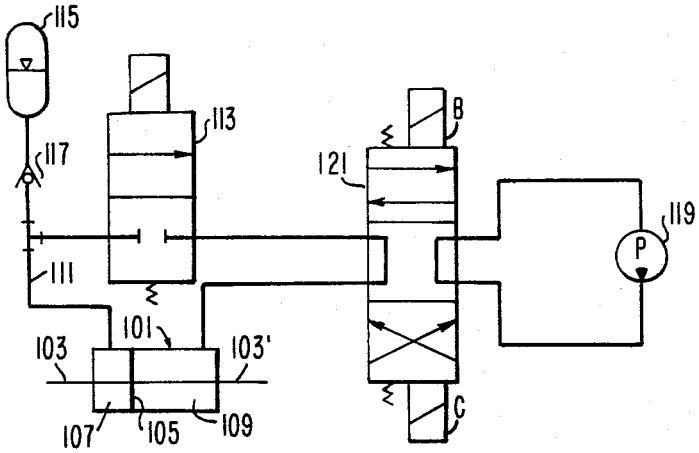
FIG. 7 is a schematic diagram of the hydraulic system of FIG. 6 modified for hydraulic recentering of the car holding arm.

While it is preferred that two hydraulic cylinders be utilized, one on each side of the car holding arm 7 as illustrated in FIGS. 1 through 4, a single cylinder on just one side of the arm could be used. In such an arrangement, the hydraulic circuits would be modified as shown in FIGS. 6 and 7. As shown in FIG. 6, the single hydraulic cylinder 101 has a piston rod 103 for connection between the car holding arm and the piston 105. The rod 103 extends all the way through the cylinder as at 103' so that the piston 105 presents working surfaces of equal area to the two chambers 107 and 109 on opposite sides of the piston. These two working chambers are interconnected by a conduit 111 having a solenoid valve 113. When valve 113 is deenergized as shown, the two chambers 107 and 109 are isolated so that the piston 105 and the car holding arm are locked against movement parallel to the track. With valve 113 energized the piston 105 is free to move as hydraulic fluid circulates through the conduit 111. As in the circuit of FIG. 4, an accumulator 115 keeps the hydraulic system full of fluid through check valve 117.

FIG. 7 illustrates the single cylinder hydraulic circuit of FIG. 6 modified by the inclusion of hydraulic pump 119 and double solenoid valve 121 which operate as indicated in connection with the description of FIG. 5 to permit the piston 105, and therefore the car holding arm, to be positioned as desired.

The car holding device described operates as follows. Assuming that the arm is raised and centered as indicated in phantom line in FIG. 2, a train is positioned by a car positioner or locomotive so that the coupling at the end of an uncoupled car, or between coupled cars, is positioned in alignment with the coupling head 21 on the car holding arm 7. The motor 27 is then energized to turn the crank 33 through gear reducer 31 and rotate the car holding arm 7 in a vertical plane about pivot pins 11 and 13 until the coupling head 21 engages the couplings 23 on the cars. As the car positioner or locomotive is uncoupled from the train, any load imposed by the train, such as would be created by a gradient in the track, is transferred to the car holding arm 7. This load which moves in a direction parallel to the track is transmitted through the piston rods to the hydraulic cylinders. With the valves 91 or 113, as the case may be, closed, movement of the car holding arm in the direction parallel to the tracks is resisted. Any shock loading applied to the car holding arm, such as by coupling additional cars to the train, is absorbed by the shock absorbers 49.

When the device is to be disengaged from the train, the car positioner or locomotive is again connected to the train. Solenoid valve 91 or 113 is then energized to open the conduits connecting the working chambers of the hydraulic cylinder(s). If any load is being carried by the car holding arm at this time, the arm will move parallel to the direction of the track causing hydraulic fluid to circulate between the cylinder working chambers until the load is transferred to the car positioner or locomotive. The arm may then be raised through energization of the motor 27. As the car holding arm 7 is raised with the solenoid valves 91 or 113 still energized, the cam arms 63 engage the roller 65 to generate a force which causes the arm to move parallel to the track 3 until it is centered. If the mechanical centering mechanism is not provided, the appropriate solenoid valve 99 or 121 can be energized and pump 97 or 119 can be turned on to recenter the arm through movement of the piston(s) in the hydraulic cylinder(s). This hydraulic positioning of the car holding arm in the direction parallel to the track can also be used to help align the car holding arm with the coupling on a car prior to engagement.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

We claim:

1. Apparatus for holding railroad cars in a train in place on a railroad track and for relieving the load carried thereby during disengagement from the train, said apparatus comprising:

a base positioned adjacent said railroad track;

a car holding arm including means on one end of said arm for engaging couplings on said railroad cars;

mounting means for mounting the car holding arm on the base for movement between a car engaging position wherein the arm engages a coupling of a car to hold that car and any other cars coupled to it in position on the track, and a retracted position wherein the cars are movable along the track relative to said car holding arm, said mounting means including means providing for movement of said car holding arm in a direction parallel to the direction of said track;

thrust absorbing means connected to said car holding arm for selectively resisting movement of the arm in a direction parallel to the railroad track; and control means for selectively conditioning said thrust absorbing means to resist movement of the car holding arm in said direction parallel to the direction of said track in response to loads imposed thereon by the cars when the arm is in engagement with the coupling on a railroad car to hold the cars in place on the track, and for conditioning said thrust absorbing means to permit movement of the car holding arm in a direction parallel to the railroad track to relieve the load imposed by said cars on said car holding arm when the car holding arm is to be moved to the retracted position, whereby the car holding arm can be moved from engagement with the car coupling for return to the retracted position without any load from the cars being imposed therein.

2. The apparatus of claim 1 wherein said thrust absorbing means includes a hydraulic cylinder positioned to one side of the car holding arm and having a piston slidable in a direction parallel to the railroad track within a working chamber definded by a housing, said piston dividing the working chamber into a first chamber and a second chamber, and piston rod means connecting said piston with said car holding arm for movement therewith, and wherein said control means includes conduit means interconnecting said first and second chambers, and valve means selectively positionable between a first position wherein flow of hydraulic fluid between the first and second chambers through the conduit means is prevented to resist movement of the car holding arm in a direction parallel to the railroad track and a second position wherein hydraulic fluid can flow between the first and second chambers through said conduit means to allow the car holding arm to move in a direction parallel to the railroad track with the railroad cars and thereby relieve the load imposed on the car holding arm by the railroad cars.

3. The apparatus of claim 1 wherein said thrust absorbing means includes a pair of hydraulic cylinders, one positioned on each side of the car holding arm and each having a piston slidable in a direction parallel to the railroad track within a working chamber defined by a housing, said piston dividing said working chamber into an inner chamber adjacent the car holding arm and an outer chamber remote therefrom, and piston rod means connecting said piston with said car holding arm for movement therewith, and wherein said control means includes first conduit means interconnecting the inner chambers of the two hydraulic cylinders, second conduit means interconnecting the outer chambers, and valve means selectively positionable between a first position wherein the flow of hydraulic fluid between the inner chambers through the first conduit means and between the outer chambers through the second conduit means is prevented to resist movement of the car holding arm in a direction parallel to the railroad track and a second position wherein hydraulic fluid can flow between the two inner chambers and between the two outer chambers through the first and second conduit means, respectively, to allow the car holding arm to move in a direction parallel to the railroad track with the railroad cars and thereby relieve the load imposed thereon by the railroad cars.

4. The apparatus of claim 2 or 3 including shock absorbing means for mounting said piston rod means to said car holding arm for absorbing impact loads imposed on said holding arm by said railroad cars.

5. The apparatus of claim 2 or 3 including means for maintaining the conduit means and hydraulic cylinder chambers filled with hydraulic fluid.

6. The apparatus of claim 2 or 3 wherein said car holding arm includes axially aligned pivot pins extending in opposite directions parallel to the railroad track from near the second end of said car holding arm, wherein said mounting means includes means for mounting said pivot pins on said base for rotation of said car holding arm in a vertical plane between said car engaging position and said retracted position and with the pivot pins also axially slidable in the mounting means, and wherein said piston rod means are connected to the adjacent pivot pin.

7. The apparatus of claim 2 or 3 including means for recentering said car holding arm on said mounting means after the load is relieved therefrom.

8. The apparatus of claim 7 wherein said means for recentering said car holding arm includes pump means connected to said conduit means for circulating hydraulic fluid between said chambers connected by said conduit means.

* * * * *